US010112099B2

(12) United States Patent
Craig et al.

(10) Patent No.: US 10,112,099 B2
(45) Date of Patent: Oct. 30, 2018

(54) PUTTING TRAINING APPARATUS

(71) Applicants: Ronald L. Craig, Citrus Heights, CA (US); Laura Craig, Citrus Heights, CA (US)

(72) Inventors: Ronald L. Craig, Citrus Heights, CA (US); Laura Craig, Citrus Heights, CA (US)

( * ) Notice: Subject to any disclaimer, the term of this patent is extended or adjusted under 35 U.S.C. 154(b) by 0 days.

(21) Appl. No.: 15/498,450

(22) Filed: Apr. 26, 2017

(65) Prior Publication Data

US 2017/0312610 A1 Nov. 2, 2017

Related U.S. Application Data

(60) Provisional application No. 62/328,489, filed on Apr. 27, 2016.

(51) Int. Cl.

| | |
|---|---|
| ***A63B 69/36*** | (2006.01) |
| *A63B 71/06* | (2006.01) |
| *A63B 53/04* | (2015.01) |

(52) U.S. Cl.

CPC ..... *A63B 69/3676* (2013.01); *A63B 69/3661* (2013.01); *A63B 2053/0441* (2013.01); *A63B 2069/3682* (2013.01); *A63B 2071/0625* (2013.01); *A63B 2071/0694* (2013.01); *A63B 2208/0204* (2013.01); *A63B 2209/08* (2013.01); *A63B 2209/10* (2013.01)

(58) Field of Classification Search

CPC ..... A63B 9/3676

See application file for complete search history.

(56) References Cited

U.S. PATENT DOCUMENTS

| | | | | |
|---|---|---|---|---|
| 3,843,136 A * | 10/1974 | Buenzle | A63B 57/40 | 473/162 |
| 5,150,904 A * | 9/1992 | Sindelar | A63B 69/3676 | 473/251 |
| 5,735,751 A * | 4/1998 | Pacheco | A63B 24/0021 | 473/186 |
| 6,623,370 B1 * | 9/2003 | Willer | A63B 67/02 | 473/157 |

* cited by examiner

*Primary Examiner* — Michael Dennis

(74) *Attorney, Agent, or Firm* — RG Patent Consulting, LLC; Rachel Gilboy

(57) ABSTRACT

A putting training apparatus is a putting training aid for teaching the accuracy of aim when putting in the game of golf. A rectangularly shaped elongated planar member, which has a flat top surface with markings that guide the user to hit the ball with a putter along a straight trajectory and into a putting cup in the elongated planar member at the opposite end from the putting end. An attachable guide having a marker attaches to the putter that the user attempts to keep placed above an offset straight line helping the stroke to move along the straight path.

17 Claims, 3 Drawing Sheets

PUTTING TRAINING APPARATUS

CROSS-REFERENCE TO RELATED APPLICATION

The present application is related to and claims priority from prior provisional application Ser. No. 62/328,489, filed Apr. 27, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of golf training accessories and more specifically relates to a putting training apparatus.

2. Description of the Related Art

Golf is a club and ball sport in which players use various clubs to hit balls into a series of holes on a course in as few strokes as possible. Golf, unlike most ball games, cannot and does not utilize a standardized playing area. The game is played on a course with an arranged progression of 18 holes. Each hole on the course must contain a tee box to start from, and a putting green containing the actual hole or cup (4.25 inches in width). There are other standard forms of terrain in between, such as the fairway, rough (long grass), sand traps, and hazards (water, rocks, fescue) but each hole on a course is unique in its specific layout and arrangement. Golf is played for the lowest number of strokes by an individual, known as stroke play, or the lowest score on the most individual holes in a complete round by an individual or team, known as match play. Stroke play is the most commonly seen format at all levels.

Golf has been a very popular sport game, which is both challenging and entertaining. One of the difficult parts of golf is hitting the ball with some degree of accuracy to get as close as possible to each successive hole. The first one or two strokes (swings) on a new hole are usually the longest, sometimes ranging as long as two to four hundred yards. As the ball is hit closer to the flag, which marks the hole, the club used changes to adjust the distance and height that the ball flies through the air. The final flag is located on a "green" which is a fine, closely mowed, grassy area with elevation contours that allows the ball to roll for considerable distances. The least number of final strokes on the green most often determines the winners of tournaments. A great amount of skill in reading of the contours and slopes of the greens is difficult and where many golfers fall behind. A great deal of practice doesn't always yield the skill development expected for the effort applied. There are training aids available that don't really reduce the size of the gap between the practice time invested and the degree of skill achieved. A training aid that will do that is needed.

Various attempts have been made to solve the above-mentioned problems in prior art but as of yet has been unsuccessful. None of the prior art, taken either singly or in combination, is seen to describe the invention as claimed.

Ideally, a golf training accessory should provide skill improvement relative to the amount of training invested, and yet, would operate reliably and be manufactured at a modest expense. Thus, a need exists for a reliable putting training apparatus to avoid the above-mentioned problems.

BRIEF SUMMARY OF THE INVENTION

In view of the foregoing disadvantages inherent in the known golf training accessories art, the present invention provides a novel putting training apparatus. The general purpose of the present invention, which will be described subsequently in greater detail, is to provide skill improvement relative to the amount of training invested.

The putting training apparatus preferably comprises an elongated planar member including a bottom surface, a top surface, and an aperture extending from and through the top surface to and through the bottom surface, a putting cup installed within the aperture that is adapted to be able to receive a golf ball, a golf ball, a golf ball positioning mark imprinted upon the top surface of the planar member, a first line extending linearly from the golf ball positioning mark to the putting cup forming a putting line with the first line including at least one ball positioning mark imprinted along the putting line, at least one elongated guiding line imprinted linearly upon the top surface of the planar member parallel to the putting line and adjacent to the golf ball positioning mark, a dome member adapted to be installed upon the putting cup that is adapted to make a sound when the golf ball is received within the putting cup, and a thin, elongated guiding member that includes a head portion and a body portion.

The guiding member is adapted to be coupled to the putter member via the body portion, and the head portion is adapted to point towards the elongated guiding lines. The guiding member is adapted to serve as a visual aid to orient the putter member along the putting line for stroking the golf ball along the guiding line.

The planar member is formed from a rectangular piece of carpeting that includes the putting line extending along the length. At least one pair of guiding lines is drawn on the left side and the right side of the ball positioning mark. The elongated planar member is adapted to lie over a ground surface with the bottom surface of the planar member contacting the ground surface.

The first line includes three spaced ball positioning marks with three pairs of guiding lines drawn on the left side and a right side of the ball positioning marks. The three spaced ball positioning marks are spaced at a distance of 3 feet, 7 feet, and 10 feet from the putting cup. The elongated guiding lines include an arrow on one end indicating the direction for stroking. The elongated guiding lines include a plurality of spaced perpendicular lines extending therefrom forming a ruler. The elongated putting line is formed as a pair of parallel spaced lines with the distance between them substantially similar to the diameter of the golf ball.

The head portion and the body portion of the guiding member form a T-shape. The body portion is longer than the head portion and includes a line along its length and the head portion includes a line along its length. The body portion of the guiding member is formed as an elongated stick, and the head portion is formed from a penny coupled to the tip of the stick. The guiding member may be formed as an elongated metal strip and may include at least one magnet adapted to allow coupling of the guiding member to the putter member with a magnetic force. The guiding member further may include an adhesive member adapted to allow coupling of the guiding member to the putter member through an adhesive force. The guiding member may include hook and loop material adapted to allow removable coupling of the guiding member to the putter member.

The putter member may include a crown portion having a line drawn thereon such that the line is adapted to be placed substantially parallel to the guiding line when the putter member is properly aligned with the putter line. The putter member may include a crown face removably coupled to the guiding member. The guiding member may include at least one magnet adapted to allow coupling of the guiding member to the crown face of the putter member through a magnetic force but may also use an adhesive member thereon adapted to allow coupling of the guiding member to the crown face of the putter member through an adhesive force. The guiding member may also use hook and loop material instead adapted to allow removable coupling of the guiding member to the crown face of the putter member.

The present invention holds significant improvements and serves as a putting training apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, putting training apparatus, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a golf training accessory and more particularly to a putting training apparatus as used to provide skill improvement relative to the amount of training invested.

Generally speaking, a putting training apparatus is a putting training aid for teaching the accuracy of aim when putting in the game of golf. A rectangularly shaped elongated planar member, which has a flat top surface with markings that guide the user to hit the ball with a putter along a straight trajectory and into a putting cup in the elongated planar member at the opposite end from the putting end. An attachable guide having a marker attaches to the putter that the user attempts to keep placed above an offset straight line helping the stroke to move along the straight path.

Figure 1:
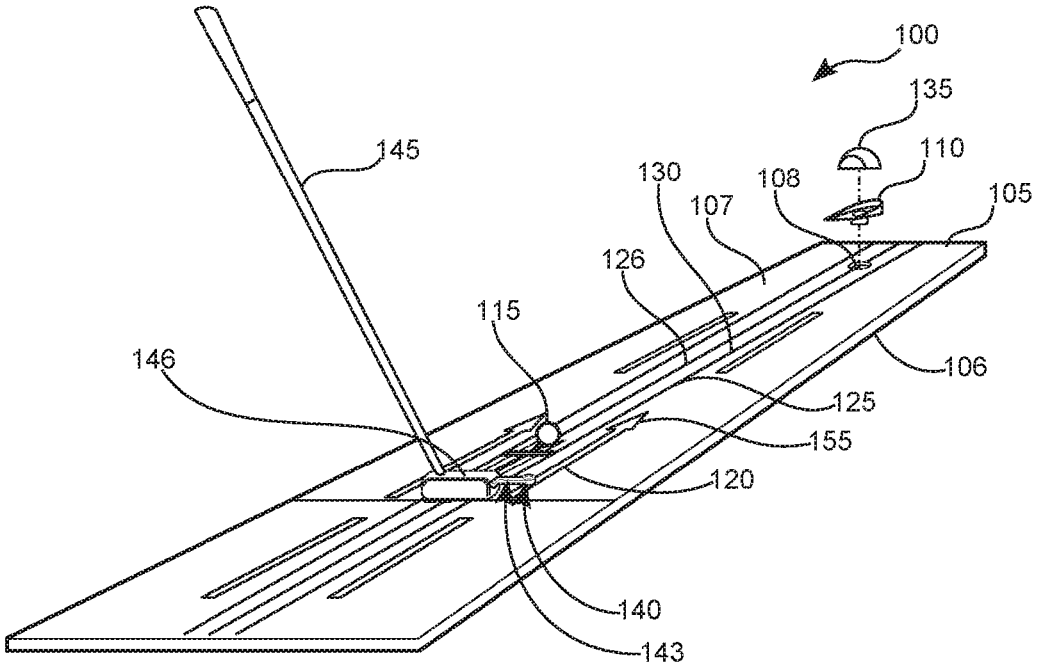
FIG. 1 shows a perspective view illustrating a putting training apparatus according to an embodiment of the present invention.

In greater detail now, referring to the drawings by numerals of reference there is shown in FIG. 1, a perspective view illustrating putting training apparatus 100 according to an embodiment of the present invention.

Putting training apparatus 100 preferably comprises elongated planar member 105 including bottom surface 106, top surface 107, and aperture 108 extending from and through top surface 107 to and through bottom surface 106, putting cup 110 installed within aperture 108 that is adapted to be able to receive golf ball 115, golf ball positioning mark 120 imprinted upon top surface 107 of elongated planar member 105, first line 125 extending linearly from golf ball 115 positioning mark to putting cup 110 forming putting line 126 with first line 125 including at least one golf ball positioning mark 120 imprinted along putting line 126, at least one elongated guiding line 130 imprinted linearly upon top surface 107 of elongated planar member 105 parallel to putting line 126 and adjacent to golf ball positioning mark 120, dome member 135 adapted to be installed upon putting cup 110 that is adapted to make a sound when golf ball 115 is received within putting cup 110, and a thin, elongated guiding member 140 that includes head portion 141 and body portion 142.

Guiding member 140 is adapted to be coupled to putter member 145 via body portion 142, and head portion 141 is adapted to point towards the elongated guiding line 130. Guiding member 140 is adapted to serve as a visual aid to orient putter member 145 along putting line 126 for stroking golf ball 115 along elongated guiding line 130.

Elongated planar member 105 is formed from a rectangular piece of carpeting that includes putting line 126 extending along the length. At least one pair of elongated guiding line(s) 130 is drawn on the left side and the right side of golf ball positioning mark 120. Elongated planar member 105 is adapted to lie over a ground surface with bottom surface 106 of elongated planar member 105 contacting the ground surface.

Figure 2:
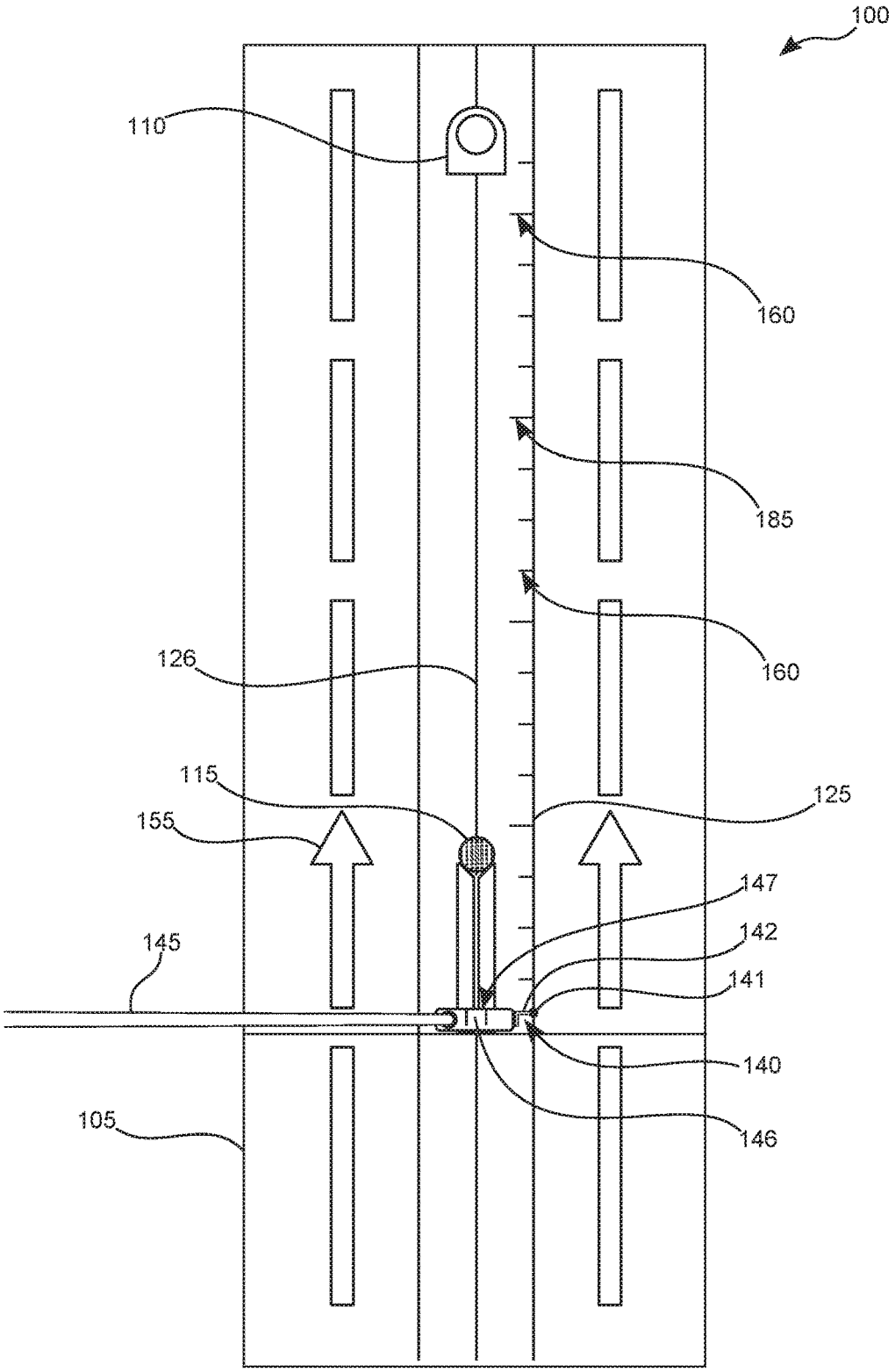
FIG. 2 is an overhead view illustrating the putting training apparatus according to an embodiment of the present invention of FIG. 1.

Referring now to FIG. 2, is an overhead view illustrating putting training apparatus 100 according to an embodiment of the present invention of FIG. 1.

First line 125 includes three spaced golf ball positioning mark(s) 120 with three pairs of elongated guiding line(s) 130 drawn on the left side and a right side of golf ball positioning mark(s) 120. The three spaced golf ball positioning mark(s) 120 are spaced at a distance of 3 feet, 7 feet, and 10 feet from putting cup 110. Elongated guiding line(s) 130 include an arrow on one end indicating the direction for stroking. Elongated guiding line(s) 130 include a plurality of spaced perpendicular lines extending therefrom forming ruler 185. The elongated putting line 126 is formed as a pair of parallel spaced lines with the distance between them substantially similar to the diameter of golf ball 115.

Head portion 141 and body portion 142 of guiding member 140 form a T-shape. Body portion 142 is longer than head portion 141 and includes a line along its length and head portion 141 includes a line along its length. Body portion 142 of guiding member 140 is formed as elongated stick 143, and head portion 141 is formed from a penny coupled to the tip of elongated stick 143. Guiding member 140 may be formed as an elongated metal strip and may include at least one magnet 170 adapted to allow coupling of guiding member 140 to putter member 145 with a magnetic force. Guiding member 140 further may include adhesive member 175 adapted to allow coupling of guiding member 140 to putter member 145 through an adhesive force. Guiding member 140 may include hook and loop material 180 adapted to allow removable coupling of guiding member 140 to putter member 145.

Figure 3:
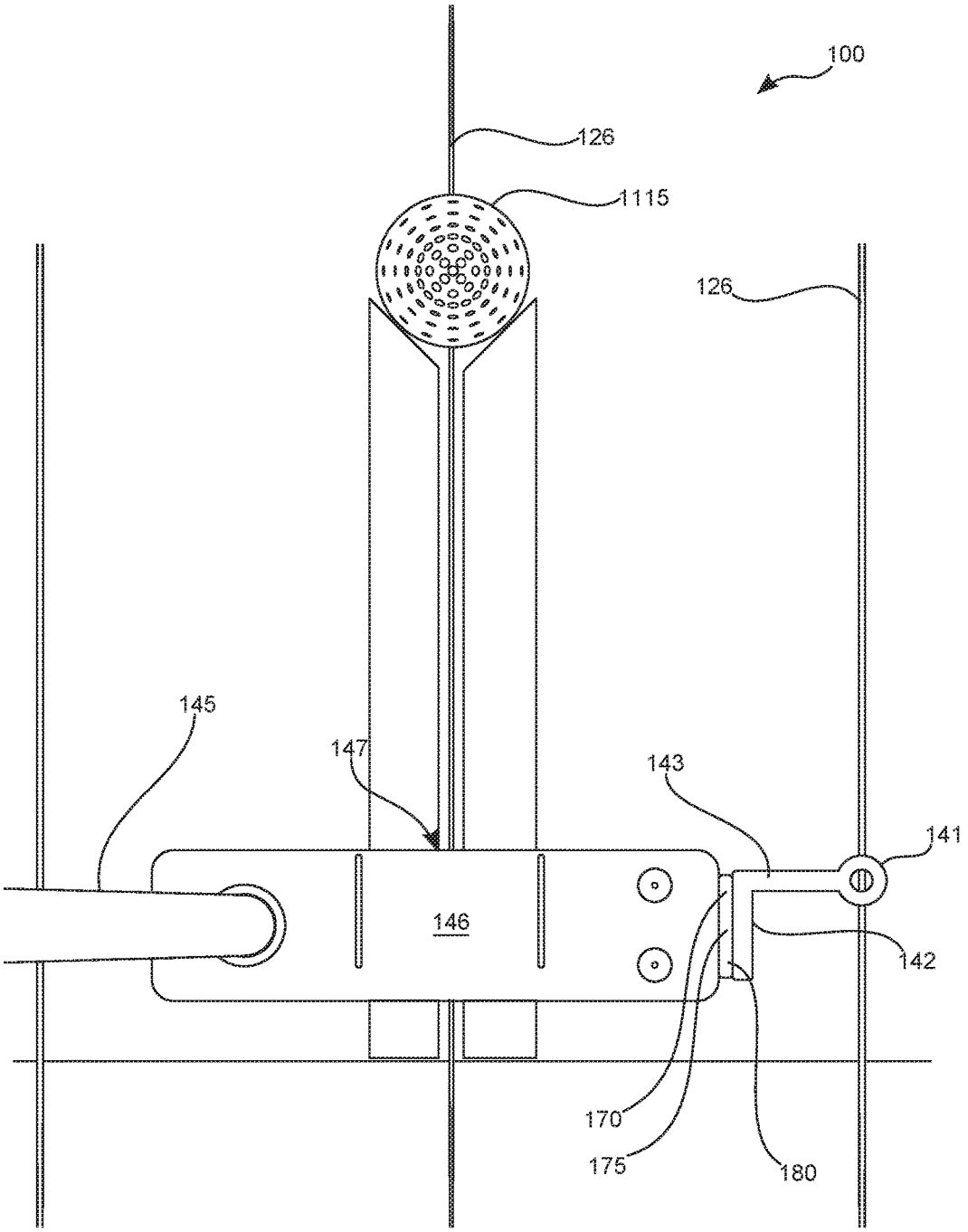
FIG. 3 is a perspective view illustrating the putting training apparatus according to an embodiment of the present invention of FIG. 1.

Referring now to FIG. 3, is a perspective view illustrating putting training apparatus 100 according to an embodiment of the present invention of FIG. 1.

Putter member 145 may include crown portion 146 having a line drawn thereon such that the line is adapted to be placed substantially parallel to elongated guiding line(s) 130 when putter member 145 is properly aligned with putting line 126. Putter member 145 may include crown face 147 removably coupled to guiding member 140. Guiding member 140 may include at least one magnet 170 adapted to allow coupling of guiding member 140 to crown face 147 of putter member 145 through a magnetic force but may also use adhesive member 175 thereon adapted to allow coupling of guiding member 140 to crown face 147 of putter member 145 through an adhesive force. Guiding member 140 may also use hook and loop material 180 instead adapted to allow removable coupling of guiding member 140 to crown portion 146 of putter member 145.

Putting training apparatus 100 is further advantageous by training a golfer to hit golf ball 115 at the right point on crown face 147. It is well known fact that only a small area of crown face 147 to which golf ball 115 strike is responsible for maximum number of successful putts. The area is known as the sweet spot. Repeated shots and practice can train the mind of the golfer to have the correct technique for orienting putter member 145. To further improve the putting skills, dummy golf balls 115 could be used. This further helps the golfer to improve the correct orientation of crown face 147. The dummy golf balls 115 could also be used along the golf mat wherein two pairs of dummy balls are placed at a distance from each other and the balls in pair are in parallel position to another pair, thus forming an imaginary line to putting cup 110.

The use of guiding member 140 helps to ensure that crown face 147 of putter member 145 is totally square and in line with putting line 126 to putting cup 110 at golf ball 115 impact. Furthermore, use of putting line 126 and guiding member 140 helps to ensure that golfer does not aim golf ball 115 but the golfer could aim putting line 126 using guiding member 140 as a visual aid while stroking putting line 126 straight on. The use of short backstrokes as well as short forward stroking motions helps to limit the possibilities of allowing crown face 147 to become angled off line. The whole idea is centered around the thought of ensuring that crown face 147 plate follows putting line 126 causing crown face 147 to perpendicularly strike golf ball 115 at the proper point on crown face 147 at all times for an in line putt thus reducing the old taught version of putting within an arc system.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within the uses mentioned, elimination or addition of certain steps, including or excluding certain markings on the top surface, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

We claim:

1. A putting training apparatus comprising:

an elongated planar member including:
- a bottom surface;
- an top surface; and
- an aperture;
  - wherein said aperture extends from and through said top surface to and through said bottom surface;
- wherein said elongated planar member planar member is adapted to lie over a ground surface with said bottom surface in contact with said ground surface;

a putting cup;
- wherein said putting cup is installed within said aperture and is adapted to receive a golf ball;

a golf ball;

a golf ball positioning mark;
- wherein said golf ball positioning mark is imprinted upon said top surface of the planar member;

a first line;
- wherein said first line extends linearly from said golf ball positioning mark to said putting cup forming a putting line; and
- wherein said first line includes at least one ball positioning mark imprinted along said putting line;

at least one elongated guiding line;
- wherein said at least one elongated guiding line is imprinted linearly upon said top surface of said planar member parallel to said putting line and adjacent to said golf ball positioning mark;

a dome member;
- wherein said dome member is adapted to be installed upon said putting cup and adapted to make a sound when said golf ball is received within said putting cup;

a putter member including:
- a crown portion;
  - wherein said crown portion includes a line drawn thereon adapted to be visible by a golfer when in use, such that said line is adapted to be placed substantially parallel to said guiding line when said putter member is properly aligned with said putter line; and an elongated and thin guiding member including:
- a head portion; and
- a body portion;

wherein said guiding member is removably coupled to said crown portion of said putter member via said body portion, and said head portion is adapted to point towards said at least one elongated guiding line;

wherein said guiding member is adapted to serve as a visual aid to orient said putter member along said putting line and stroking said golf ball along said guiding line.

2. The putting training apparatus of claim 1, wherein said planar member is formed from a rectangular piece of carpeting including said putting line extending along the length thereof, and at least one pair of guiding lines drawn on a left side and a right side of said ball positioning mark.

3. The putting training apparatus of claim 2, wherein said first line includes three spaced ball positioning marks; and wherein there are three pairs of guiding lines drawn on said left side and a right side of said ball positioning mark.

4. The putting training apparatus of claim 3, wherein said three spaced ball positioning marks are spaced at a distance of 3 feet, 7 feet, and 10 feet from said putting cup.

5. The putting training apparatus of claim 1, wherein said at least one elongated guiding line includes an arrow on one end indicating a direction of stroking.

6. The putting training apparatus of claim 1, wherein said at least one elongated guiding line includes a plurality of spaced perpendicular lines extending therefrom forming a ruler.

7. The putting training apparatus of claim 1, wherein said elongated putting line is formed as a pair of parallel spaced lines, wherein the distance therebetween is substantially similar to the diameter of said golf ball.

8. The putting training apparatus of claim 1, wherein said head portion and said body portion of said guiding member forms a T-shape; wherein said body portion is longer than said head portion and includes a line along its length; and said head portion includes a line along its length.

9. The putting training apparatus of claim 1, wherein said body portion of said guiding member is formed as an elongated stick; and said head portion is formed from a penny coupled to a tip of said stick.

10. The putting training apparatus of claim 1, wherein said guiding member is formed as an elongated metal strip.

11. The putting training apparatus of claim 1, wherein said guiding member further includes at least one magnet adapted to allow coupling of said guiding member to a putter member through a magnetic force.

12. The putting training apparatus of claim 1, wherein said guiding member further includes an adhesive member thereon adapted to allow coupling of said guiding member to a putter member through an adhesive force.

13. The putting training apparatus of claim 1, wherein said guiding member further includes hook and loop material thereon adapted to allow removable coupling of said guiding member to a putter member.

14. The putting training apparatus of claim 1, wherein said putter member further includes a crown face; and wherein said guiding member is removably coupled to said crown face.

15. The putting training apparatus of claim 14, wherein said guiding member further includes at least one magnet adapted to allow coupling of said guiding member to said crown face of said putter member through a magnetic force.

16. The putting training apparatus of claim 14, wherein said guiding member further includes an adhesive member thereon adapted to allow coupling of said guiding member to said crown face of said putter member through an adhesive force.

17. The putting training apparatus of claim 14, wherein said guiding member further includes hook and loop material thereon adapted to allow removable coupling of said guiding member to said crown face of said putter member.

* * * * *